US007950828B2

(12) United States Patent
Zhang et al.

(10) Patent No.: US 7,950,828 B2
(45) Date of Patent: May 31, 2011

(54) LED LAMP

(75) Inventors: Wen-Xiang Zhang, Shenzhen (CN); Guang Yu, Shenzhen (CN); Jin-Song Feng, Shenzhen (CN); Zhi-Yong Zhou, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 548 days.

(21) Appl. No.: 12/024,964

(22) Filed: Feb. 1, 2008

(65) Prior Publication Data

US 2009/0141494 A1 Jun. 4, 2009

(30) Foreign Application Priority Data

Nov. 30, 2007 (CN) ..... 2007 1 0077454

(51) Int. Cl.
*F21V 29/00* (2006.01)

(52) U.S. Cl. ..... 362/294; 362/249.03; 362/373; 362/231

(58) Field of Classification Search ..... 362/249.03, 362/373, 294, 249.01–249.06, 240, 800, 362/249
See application file for complete search history.

(56) References Cited

U.S. PATENT DOCUMENTS

2008/0089071 A1* 4/2008 Wang ..... 362/294
2009/0059605 A1* 3/2009 Xu et al. ..... 362/373

FOREIGN PATENT DOCUMENTS

CN 2808198 Y 8/2006

* cited by examiner

*Primary Examiner* — Evan Dzierzynski
(74) *Attorney, Agent, or Firm* — Jeffrey T. Knapp

(57) ABSTRACT

An LED lamp includes a first heat sink, a second heat sink and a plurality of LED modules. The second heat sink is located at a lateral side of the first heat sink and pivotally connects with the first heat sink. The LED modules are evenly attached on bottoms of the first and second heat sinks. The second heat sink can be rotated relative to the first heat sink to be fixed at a required position, whereby an illumination angle of the LED lamp can be adjusted. Heat generated by the LED modules is dissipated by the first and second heat sinks.

7 Claims, 6 Drawing Sheets

LED LAMP

BACKGROUND OF THE INVENTION

1. Field of the Invention

The present invention relates to an LED lamp, and more particularly to an LED lamp having an adjustable device for adjusting the LED lamp to assume various angles of illumination. Furthermore, the LED lamp has a heat dissipation device for dissipating heat generated by the LED lamp.

2. Description of Related Art

The technology of light emitting diodes has rapidly developed in recent years from indicators to illumination applications. With the features of long-term reliability, environment friendliness and low power consumption, the LED is viewed as a promising alternative for future lighting products.

A conventional LED lamp comprises a heat sink and a plurality of LED modules having LEDs attached to an outer surface of a heat sink to dissipate heat generated by the LEDs. The outer surface of the heat sink generally is a plane and the LEDs are arranged close to each other. When the LED lamp works, the LEDs mounted on the planar outer surface of the heat sink only form a flat light source. However, once the LED lamp is fixed under a determined circumstance, a direction of a light emitted by the LED lamp cannot be changed to meet different requirements. Generally, when it is necessary to change the illumination direction, the LED lamp must be remounted or redesigned, which is unduly time-consuming and raises production costs.

Thus, it is desired to devise a new LED lamp which can vary an illumination angle of the LED lamp to meet different requirements. Meanwhile, the heat generated by LEDs of the new LED lamp can be timely dissipated.

SUMMARY OF THE INVENTION

An LED lamp includes a first heat sink, a second heat sink and a plurality of LED modules. The second heat sink is located at a lateral side of the first heat sink and pivotally connects with the first heat sink. The LED modules are evenly attached on bottoms of the first and second heat sinks. The second heat sink can rotate between a first position and a second position relative to the first heat sink to vary an illumination angle of the LED lamp.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
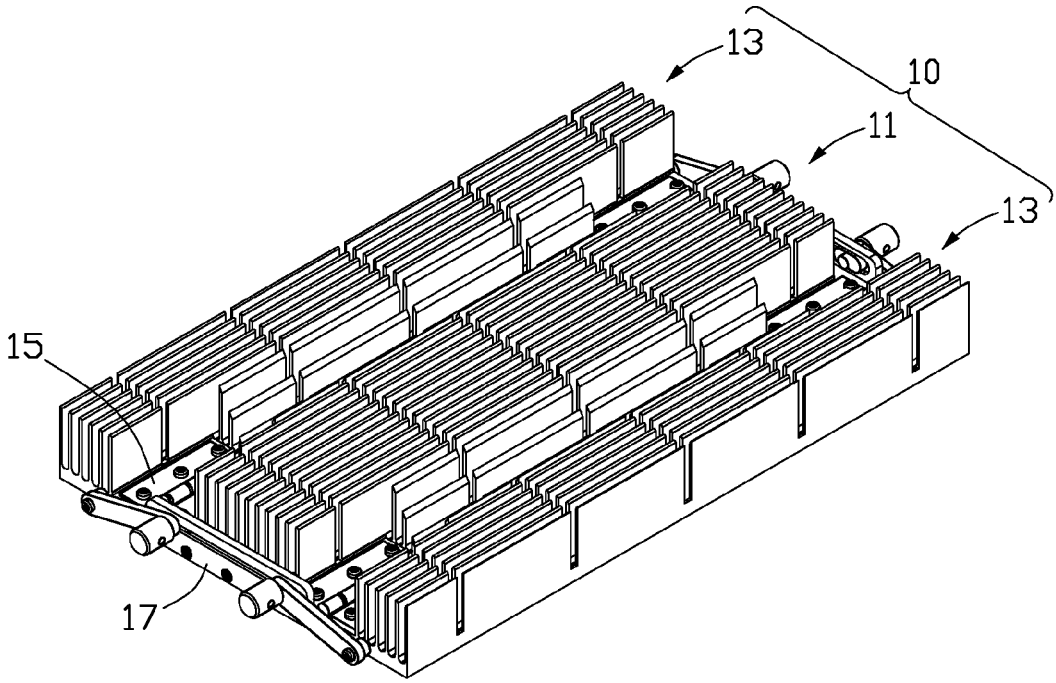
FIG. 1 is an assembled view of an LED lamp with an adjustable device in accordance with a preferred embodiment of the present invention.
Figure 2:
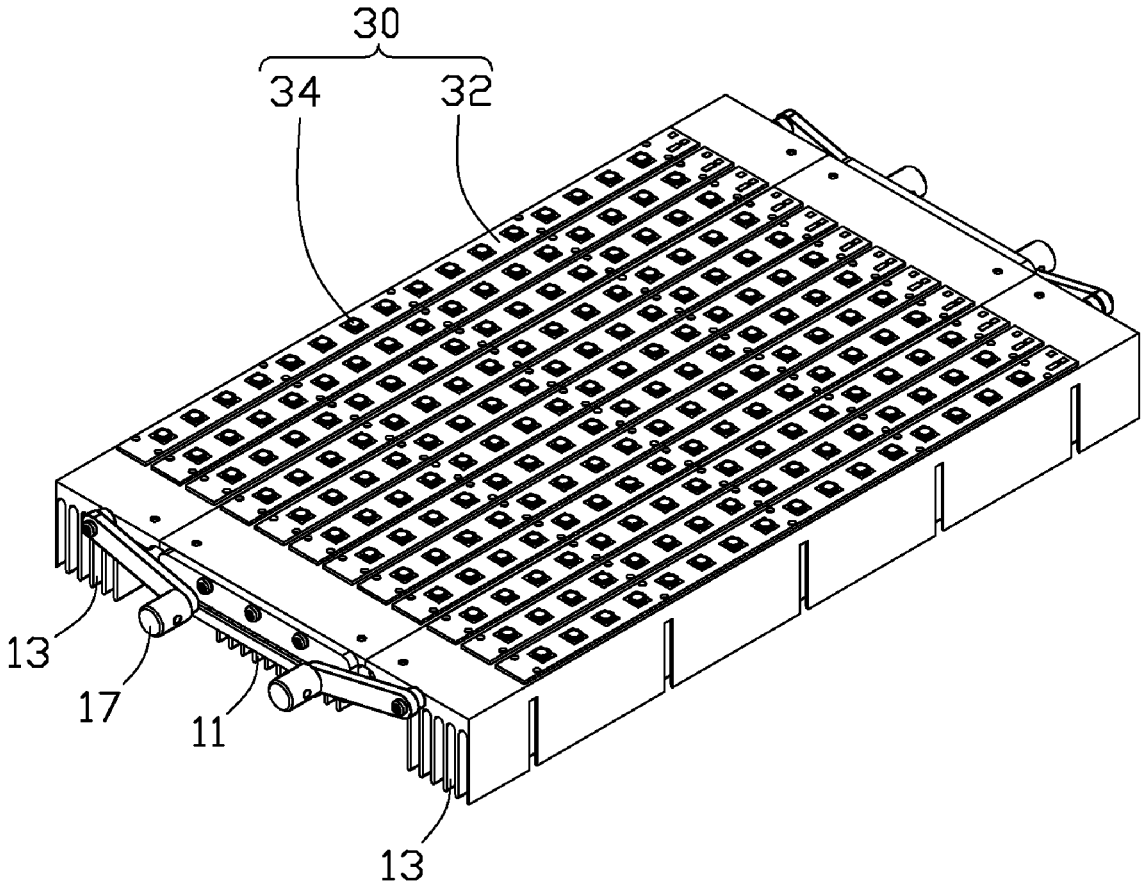
FIG. 2 is similar to FIG. 1, but viewed from a different aspect.

Referring to FIGS. 1-2, an LED lamp in accordance with a preferred embodiment of the present invention comprises a heat dissipation device 10, an adjustable device (not labeled) mounted on the heat dissipation device 10 for varying a direction of illumination of the LED lamp and a plurality of LED modules 30 mounted on the heat dissipation device 10. The heat dissipation device 10 is used to cool down the LED modules 30 to keep them working within an acceptable temperature range.

Figure 3:
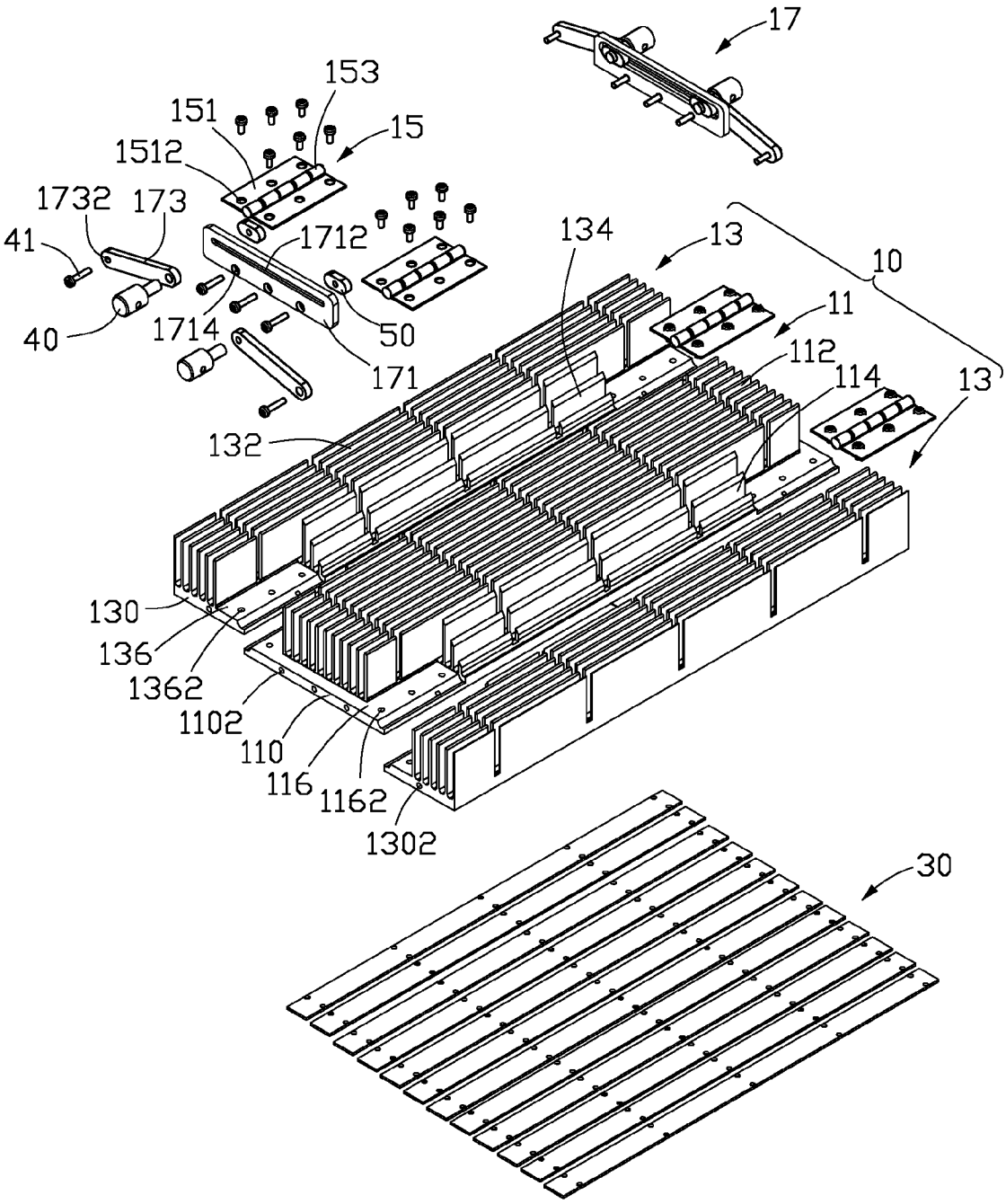
FIG. 3 is an exploded view of FIG. 1.
Figure 4:
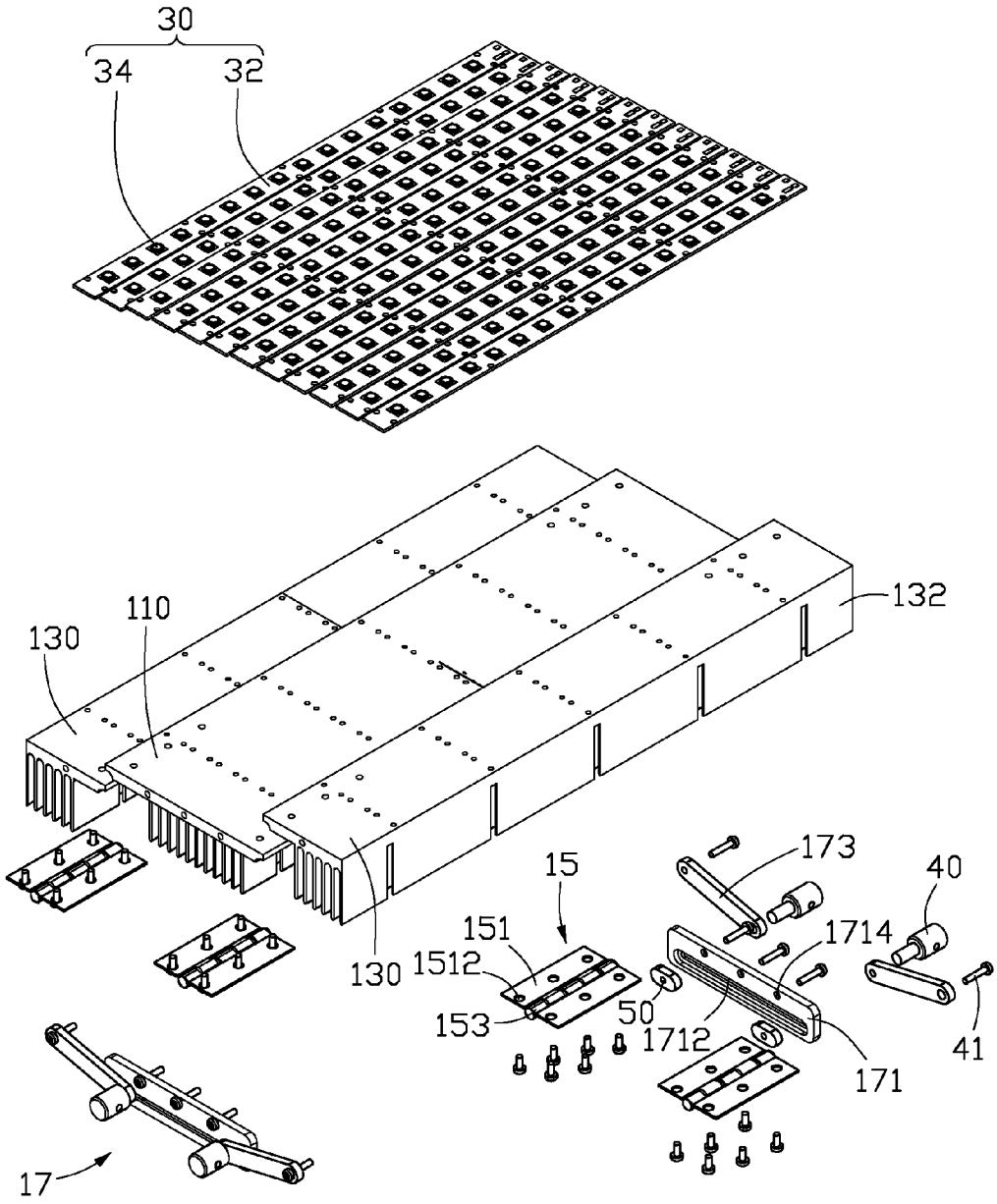
FIG. 4 is similar to FIG. 3, but viewed from a different aspect.

Referring to FIGS. 3-4, the heat dissipation device 10 comprises a first heat sink 11, and two second heat sinks 13 located at opposite sides of the first heat sink 11. The first and second heat sinks 11, 13 each are integrally formed by aluminum extrusion. Two pairs of metal hinges 15 are located between the first heat sink 11 and the second heat sinks 13 to hinge the first and second heat sinks 11, 13 together for achieving pivotal movement of the second heat sinks 13 relative to the first heat sink 11. The adjustable device comprises a pair of angle regulators 17 mounted on front and rear ends of the heat dissipation device 10 respectively to adjust positions of the second heat sinks 13 relative to the first heat sink 11. The angle regulators 17 enable the second heat sinks 13 to rotate relative to the first heat sink 11.

The first heat sink 11 comprises a rectangular base 110, a plurality of first fins 112 and second fins 114 located at two flanks of the first fins 112. The first and second fins 112, 114 perpendicularly extend from a top surface (not labeled) of the base 110. The first fins 112 are distributed from the front end to the rear end of the base 110. An extending length of the first fins 112 along the front end to rear end of the base 110 is longer than that of the second fins 114. The second fins 114 are located at middle portions of lateral sides of the first fins 112 in a manner such that mounting portions 116 are defined in front and in rear of the second fins 114. Each first fin 112 has a height equal to each other. Each of the second fins 114 has a height gradually decreased along a transverse direction away from the first fins 112. Each of the second fins 114 has a height shorter than that of the first fins 112. The first and second fins 112, 114 are arranged in multiple rows and columns. Each of the first and second fins 112, 114 is evenly spaced from and parallel to each other. The mounting portions 116 are located at four corners of the base 110 for engaging with the hinges 15. Each mounting portion 116 defines three aligned screw holes 1162 in a top surface thereof. The front and rear edges of the base 110 each evenly define three mounting holes 1102 therein for mounting of the angle regulators 17 to the base 110.

Each second heat sink 13 is similar to the first heat sink 11, and comprises a rectangular base 130, a plurality of first fins 132 and second fins 134. The first and second fins 132, 134 perpendicularly extend from a top surface of the base 130. The first fins 132 and the second fins 134 are respectively located at two opposite lateral sides of the base 130. Each of the first fins 132 has a height equal to each other. The second fins 134 are located near the first heat sink 11. Each of second fins 134 has a height gradually decreased towards the first heat sink 11 and is shorter than that of the first fin 132. Each of the first and second fins 132, 134 is evenly spaced from and parallel to each other. A front corner and a rear corner of the base 130 of each second heat sink 13 near the first heat sink 11 form two rectangular mounting portions 136 corresponding to the mounting portions 116 of the first heat sink 11. Each mounting portion 136 defines three aligned screw holes 1362 in a top surface thereof. Each of a front edge and a rear edge of each second heat sink 13 defines a mounting hole 1320 for engaging with the angle regulators 17.

Each LED module 30 comprises an elongated printed circuit board 32 and a plurality of spaced LEDs 34 evenly mounted on a side of the printed circuit board 32. The LEDs 34 of each LED module 30 are arranged along a longitudinal direction of the printed circuit board 32. The LED modules 30 are equidistantly mounted on bottom surfaces of the bases 110, 130 of the first and second heat sinks 11, 13 of the heat dissipation device 10.

Each hinge 15 comprises a pair of mounting plates 151 and a shaft 153. The mounting plates 151 are located at opposite sides of the shaft 153 and pivotally engaged with the shaft 153. The mounting plates 151 define three through holes 1512 respectively corresponding with the screw holes 1362 of the base 130 of the second heat sink 13 and the screws holes 1162 of the base 110 of the first heat sink 11. A plurality of screws (not labeled) extend through the through holes 1512 of the mounting plates 151 to be engaged in the screw holes 1162, 1362 of the first and second heat sinks 11, 13 to mount the hinges 15 on the first and second heat sinks 11, 13; thus, the first and second heat sinks 11, 13 are pivotally connected with each other. The second heat sinks 13 can rotate up-and-down around the shafts 153 of the hinges 15 so that they can pivot relative to the first heat sink 11 to vary a direction of light emitted from the LED modules 30 attached to the second heat sinks 13, according to different requirements.

Figure 5:
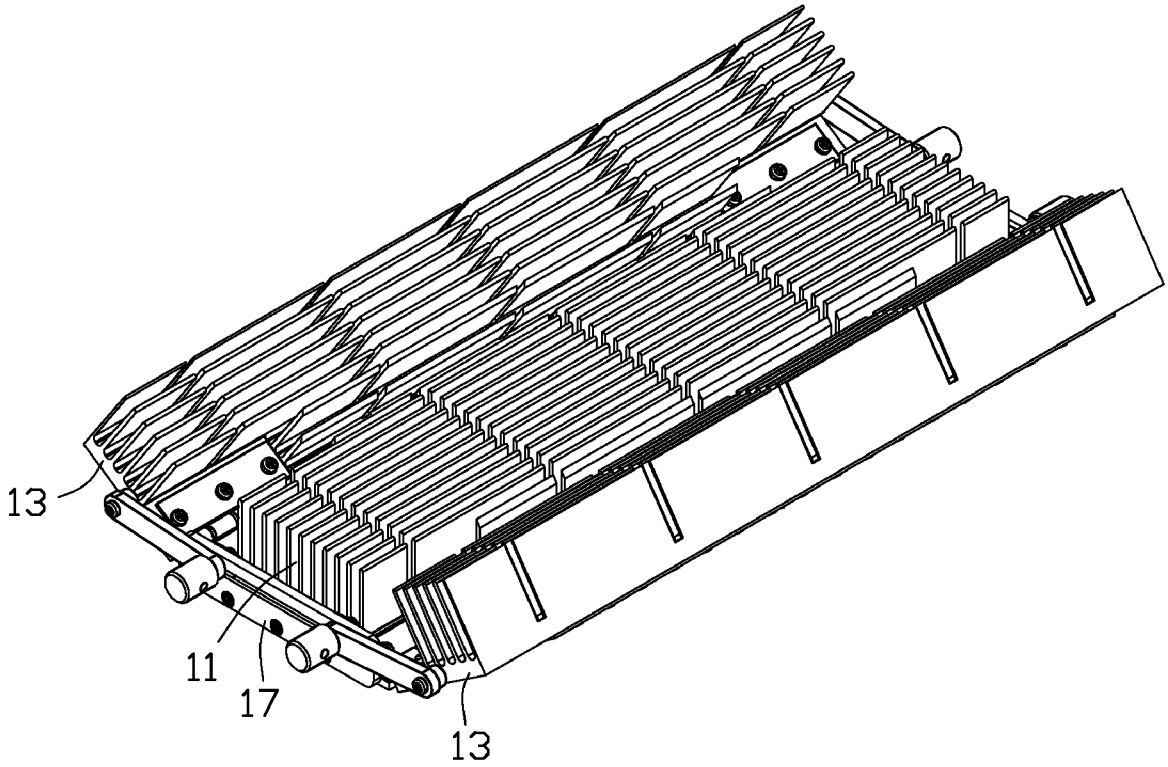
FIG. 5 is similar to FIG. 1, wherein the adjustable device rotates to a specifically determined angle.
Figure 6:
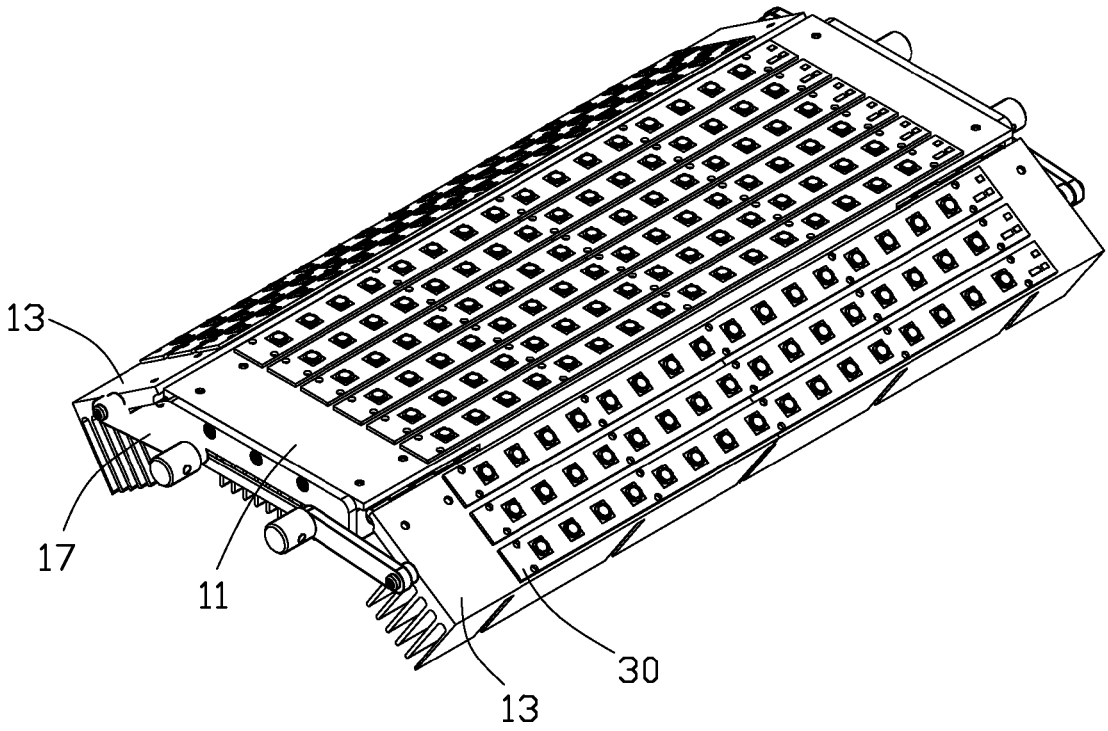
FIG. 6 is similar to FIG. 5, but viewed from a different aspect.

Each angle regulator 17 comprises an elongated, rectangular mounting beam 171 secured on the front or rear end of the first heat sink 11, and two connecting cranks 173 connecting the mounting beam 171 with the two second heat sinks 13 respectively. The mounting beam 171 defines an elongated slot 1712 at a top portion thereof, and three mounting holes 1714 are equidistantly defined in a bottom portion of the mounting beam 171. Each mounting hole 1714 is aligned with a corresponding mounting hole 1102 of the base 110 of the first heat sink 11. Screws (not labeled) extend through the mounting holes 1712 of the mounting beam 171 to be engaged in the mounting holes 1102 of the first heat sink 11 to mount the mounting beam 171 on the first heat sink 11. Each connecting crank 173 is elongated and defines two through holes 1732 located at opposite upper and lower ends thereof. A fastener 40 extends through the upper through hole 1732 of the connecting crank 173 and the slot 1712 of the mounting beam 171 to engage with an elongated nut 50 to attach the upper end of each connecting crank 173 on the mounting beam 171. Simultaneously, a screw 41 extends through the lower through hole 1732 of the connecting crank 173 to be engaged in the mounting hole 1302 of the second heat sink 13 to fix the lower end of the connecting crank 173 on the second heat sink 13. The fastener 40 comprises a head (not labeled) and an elongated shaft (not labeled) perpendicularly inserted in the slot 1712 and slidable along the slot 1712. The slot 1712 has a height which is slightly larger than an outer diameter of the shaft of the fastener 40. The fastener 40 terminates with a screwed end (not shown). Referring to FIG. 2, in an initial position, bottoms of the bases 110, 130 of the first and second heat sinks 11, 13 are coplanar and the shaft of each fastener 40 abuts against the mounting beam 171 defining an outmost end of the slot 1712; the nut 50 loosely engages with the screwed end of the fastener 40 in a manner such that the position of the second heat sink 13 can be adjusted relative to the first heat sink 11 to change the illumination angle of the LED lamp. The upper ends of the connecting cranks 173 connected to the mounting beam 171 move along the slot 1712 in such a manner that the second heat sinks 13 together with the lower ends of the connecting cranks 173 are driven to rotate upwardly relative to the first heat sink 11. Referring to FIGS. 5-6, once the illumination angle is determined, the nuts 50 are rotated to firmly engage with the fasteners 40 to make the connecting cranks 173 be securely mounted to the mounting beams 171 and the second heat sinks 13. Thus, the LED lamp is assembled together and the LED modules 30 are oriented at the required directions.

In use, when the LEDs 34 of the LED modules 30 emit light, heat generated by the LEDs 34 is absorbed by the bases 110, 130 of the first and second heat sinks 11, 13, and then transfers to the first fins 112, 132 and the second fins 114, 134 of the first and second heat sinks 11, 13, respectively. Finally the heat is dispersed into ambient cool air via the fins 112, 132, 114, 134. Thus a temperature of the LEDs 34 can be maintained within the required operation range of temperature. Thus, the present invention can also have an improved heat dissipating efficiency for preventing the LEDs 34 from overheating.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a first heat sink;

a second heat sink located at a lateral side of the first heat sink and pivotally connecting with the first heat sink;

a pair of angle regulators secured on a front end and a rear end of each of the first and second heat sinks to adjust a position of the second heat sink relative to the first heat sink; and a plurality of LED modules evenly attached on bottoms of the first and second heat sinks;

wherein the second heat sink is able to rotate between a first position and a second position relative to the first heat sink to vary an illumination angle of the LED lamp.

2. The LED lamp as claimed in claim 1, wherein the first and second heat sinks are assembled together via at least a hinge located between the first and second heat sinks.

3. The LED lamp as claimed in claim 2, wherein the at least a hinge comprises a shaft and a pair of mounting plates located at opposite sides of the shaft and mounted on the first and second heat sinks respectively.

4. The LED lamp as claimed in claim 1, wherein each angle regulator comprises a mounting beam secured on one of the front and rear ends of the first heat sink and a connecting crank mounted on the mounting beam of the each angle regulator and the second heat sink, when the second heat sink rotates around the first heat sink, an end of the connecting crank attached to the mounting beam moving along a longitudinal direction of the mounting beam of the each angle regulator.

5. The LED lamp as claimed in claim 1, wherein each of the first and second heat sinks comprises a base and a plurality first and second fins extending upwardly from the bases, each of the first fins has a height equal to each other, and the second fins have heights gradually decreased along a transverse direction of the each of the first and second heat sinks.

6. The LED lamp as claimed in claim 5, wherein the first and second fins of the each of the first and second heat sinks are arranged in rows evenly spaced from and parallel to each other.

7. An LED lamp comprising:

a first heat sink having a bottom and a plurality of fins extending away from the bottom;

at least a second heat sink having a bottom and a plurality of fins extending away from the bottom of the at least a second heat sink;

at least a hinge pivotably connecting the first heat sink and the at least a second heat sink together;

an angle regulator having a beam secured to the first heat sink, the beam defining an elongated slot therein, at least a crank with a first end fixed to the at least a second heat sink and a second end attached to the beam and movable along the slot; and a plurality of LED modules attached to the bottoms of the first heat sink and the at least a second heat sink.

* * * * *